US009976323B2

(12) United States Patent
Nozawa et al.

(10) Patent No.: US 9,976,323 B2
(45) Date of Patent: May 22, 2018

(54) VEHICLE DOOR LATCH DEVICE

(71) Applicant: MITSUI KINZOKU ACT CORPORATION, Kanagawa (JP)

(72) Inventors: Hideaki Nozawa, Kanagawa (JP); Tomoharu Nagaoka, Kanagawa (JP)

(73) Assignee: MITSUI KINZOKU ACT CORPORATION, Kanagawa (JP)

( * ) Notice: Subject to any disclaimer, the term of this patent is extended or adjusted under 35 U.S.C. 154(b) by 265 days.

(21) Appl. No.: 14/968,408

(22) Filed: Dec. 14, 2015

(65) Prior Publication Data

US 2016/0177599 A1 Jun. 23, 2016

(30) Foreign Application Priority Data

Dec. 19, 2014 (JP) ..... 2014-257574

(51) Int. Cl.
*E05C 3/16* (2006.01)
*E05B 85/24* (2014.01)
*E05B 77/10* (2014.01)

(52) U.S. Cl.
CPC ..... *E05B 85/243* (2013.01); *E05B 77/10* (2013.01)

(58) Field of Classification Search
CPC ..... Y10T 292/1082; Y10T 292/1047; E05B 77/00; E05B 77/02; E05B 77/04; E05B 77/10; E05B 85/00; E05B 85/02; E05B 85/24; E05B 85/243; Y10S 292/23; Y10S 292/53; Y10S 292/64
See application file for complete search history.

(56) References Cited

U.S. PATENT DOCUMENTS 2,700,565 A * 1/1955 Smith ..... E05B 85/24 292/221
5,172,946 A * 12/1992 Dowling ..... E05B 83/16 292/216
5,186,504 A * 2/1993 Takaishi ..... E05B 85/02 292/216

(Continued)

FOREIGN PATENT DOCUMENTS

CN 203547306 U 4/2014
CN 204002140 U 12/2014

(Continued)

OTHER PUBLICATIONS

First Office Action for corresponding Chinese Patent Application No. 201510923786.9, dated Jul. 14, 2017.

*Primary Examiner* — Alyson M Merlino
(74) *Attorney, Agent, or Firm* — McDermott Will & Emery LLP

(57) ABSTRACT

A vehicle door latch device includes: a body which is provided in one of a door of a vehicle or a vehicle body, a striker advancing groove being formed on one surface of the body; a latch configured to be meshed with the advanced striker to hold the door at a closed position; a cover plate installed on the surface of the body on which the striker advancing groove is formed; and a back plate fixed to the cover plate with the body placed therebetween. One of the cover plate or the back plate includes a projected part which is projected in an inside-outside direction of the vehicle. Other one of the cover plate or the back plate includes an engagement hole into which the projected part advances.

5 Claims, 12 Drawing Sheets

(56) References Cited

U.S. PATENT DOCUMENTS

| | | | | |
|---|---|---|---|---|
| 6,042,160 | A * | 3/2000 | Hamada | E05B 83/16 292/216 |
| 2002/0167177 | A1 | 11/2002 | Erices et al. | |
| 2007/0040391 | A1 * | 2/2007 | Fujihara | E05B 81/20 292/201 |
| 2008/0122230 | A1 * | 5/2008 | Okada | E05B 79/04 292/259 A |
| 2016/0290020 | A1 * | 10/2016 | Nozawa | E05B 85/02 |

FOREIGN PATENT DOCUMENTS

| | | | |
|---|---|---|---|
| DE | 10212217 | A1 | 10/2003 |
| EP | 0894925 | A1 | 2/1999 |
| JP | 4765123 | B2 | 6/2011 |
| JP | 2012-233318 | A | 11/2012 |
| WO | 2013105408 | A1 | 7/2013 |

* cited by examiner

VEHICLE DOOR LATCH DEVICE

CROSS-REFERENCE TO RELATED APPLICATION(S)

The present application claims priority to and incorporates by reference the entire contents of Japanese Patent Application No. 2014-257574 filed in Japan on Dec. 19, 2014.

BACKGROUND OF THE INVENTION

1. Field of the Invention

The present invention relates to a vehicle door latch device.

2. Description of the Related Art

As a vehicle door latch device, there is a door latch device including a synthetic resin body fixed to a door, a latch which is housed in the body and which can be engaged to a striker on a vehicle body side, and an engagement mechanism such as a pole which can be engaged with the latch (see, for example, Japanese Patent No. 4765123 and Japanese Patent Application Laid-open No. 2012-233318).

It is preferable that a door latch device has high impact resistance with respect to impact in vehicle collision or the like. Specifically, in order to secure safety in vehicle collision, it is desired that engagement between a striker and a latch is not released when impact due to vehicle collision is applied to the door latch device from an outside of the vehicle. Thus, it is preferable that unintended deformation due to force applied from the outside of the vehicle is suppressed in the door latch device.

SUMMARY OF THE INVENTION

It is an object of the present invention to at least partially solve the problems in the conventional technology.

A vehicle door latch device includes: a body which is provided in one of a door of a vehicle or a vehicle body, a striker advancing groove into which a striker provided in other one of the door or the vehicle body advances along with closing movement of the door being formed on one surface of the body; a latch configured to be meshed with the advanced striker to hold the door at a closed position; a cover plate installed on the surface of the body on which the striker advancing groove is formed; and a back plate fixed to the cover plate with the body placed therebetween. One of the cover plate or the back plate includes a projected part which is arranged in an outside of the vehicle when the vehicle door latch device is attached to the vehicle and which is projected in an inside-outside direction of the vehicle. Other one of the cover plate or the back plate includes an engagement hole into which the projected part advances when the projected part is displaced in the inside direction of the vehicle by deformation due to force applied from the outside of the vehicle.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

In the following, an embodiment of a vehicle door latch device according to the present invention will be described with reference to the drawings. Note that the present invention is not limited to this embodiment. Also, in a description of the drawings, the same reference signal is arbitrarily assigned to identical or corresponding components.

Figure 1:
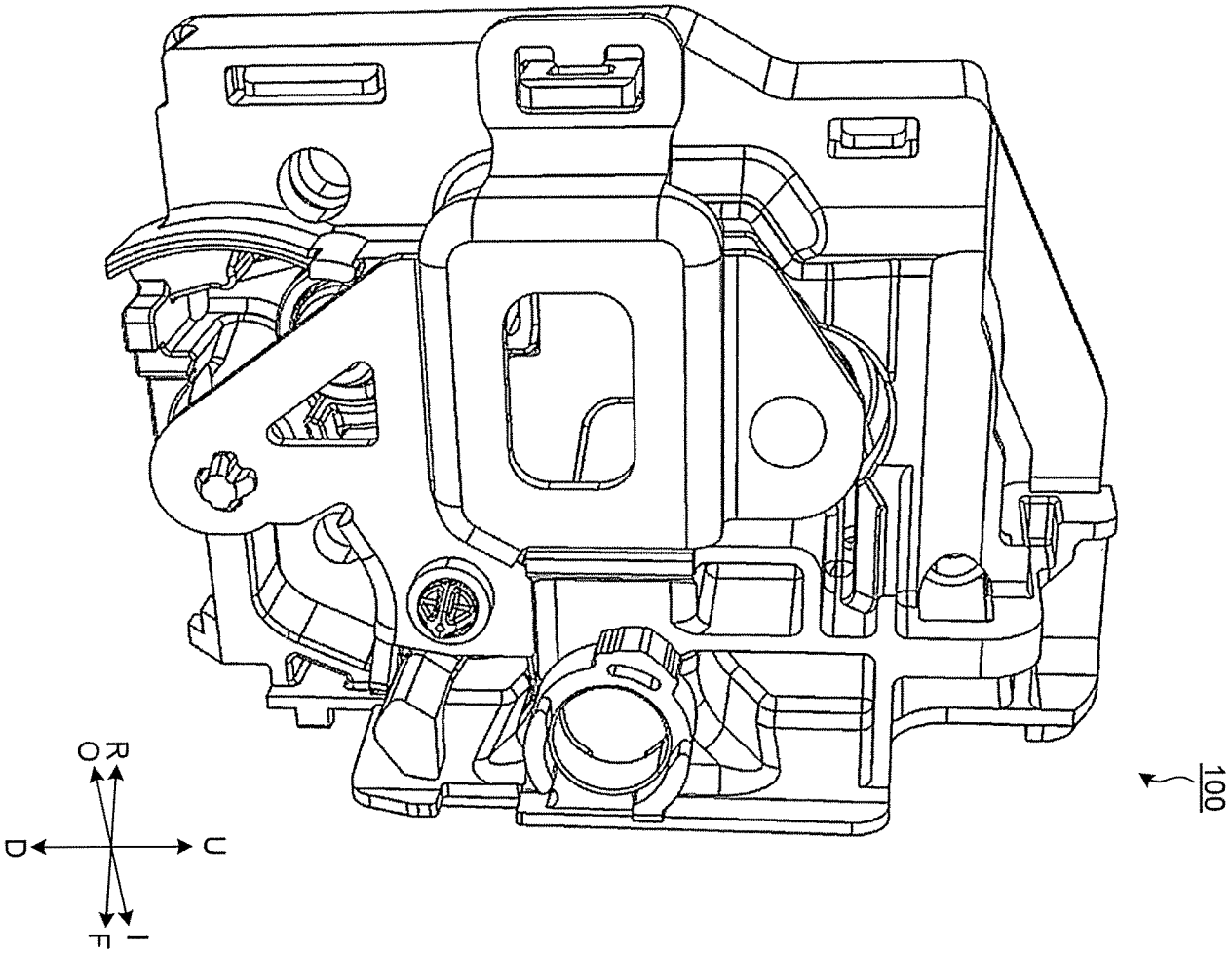
FIG. 1 is a perspective view of a vehicle door latch device according to an embodiment of the present invention.

In the following, a vehicle door latch device of the present embodiment will be described based on FIG. 1 to FIG. 12. FIG. 1 is a perspective view of a vehicle door latch device according to an embodiment of the present invention. Note that in the following description, in a state in which a door latch device 100 is attached to a vehicle, a description will be made with a right side in FIG. 1 as an "inside of a vehicle (I)," a left side therein as an "outside of a vehicle (O)," an upside therein as an "upside (U)," a down side therein as a "down side (D)," a front side in the drawing as a "front side (F)," and a deeper side in the drawing as a "rear side (R)" The definition of these directions is for convenience of a description. A direction of the door latch device 100 varies depending on a kind of a vehicle to which the device is attached, an attachment position of the device, or the like.

The door latch device 100 of the present embodiment is attached to a rear end of a rear side door (hereinafter, referred to as door) on a right side of an automobile and holds the door closed by being engaged with a striker on a side of a vehicle body.

Figure 2:
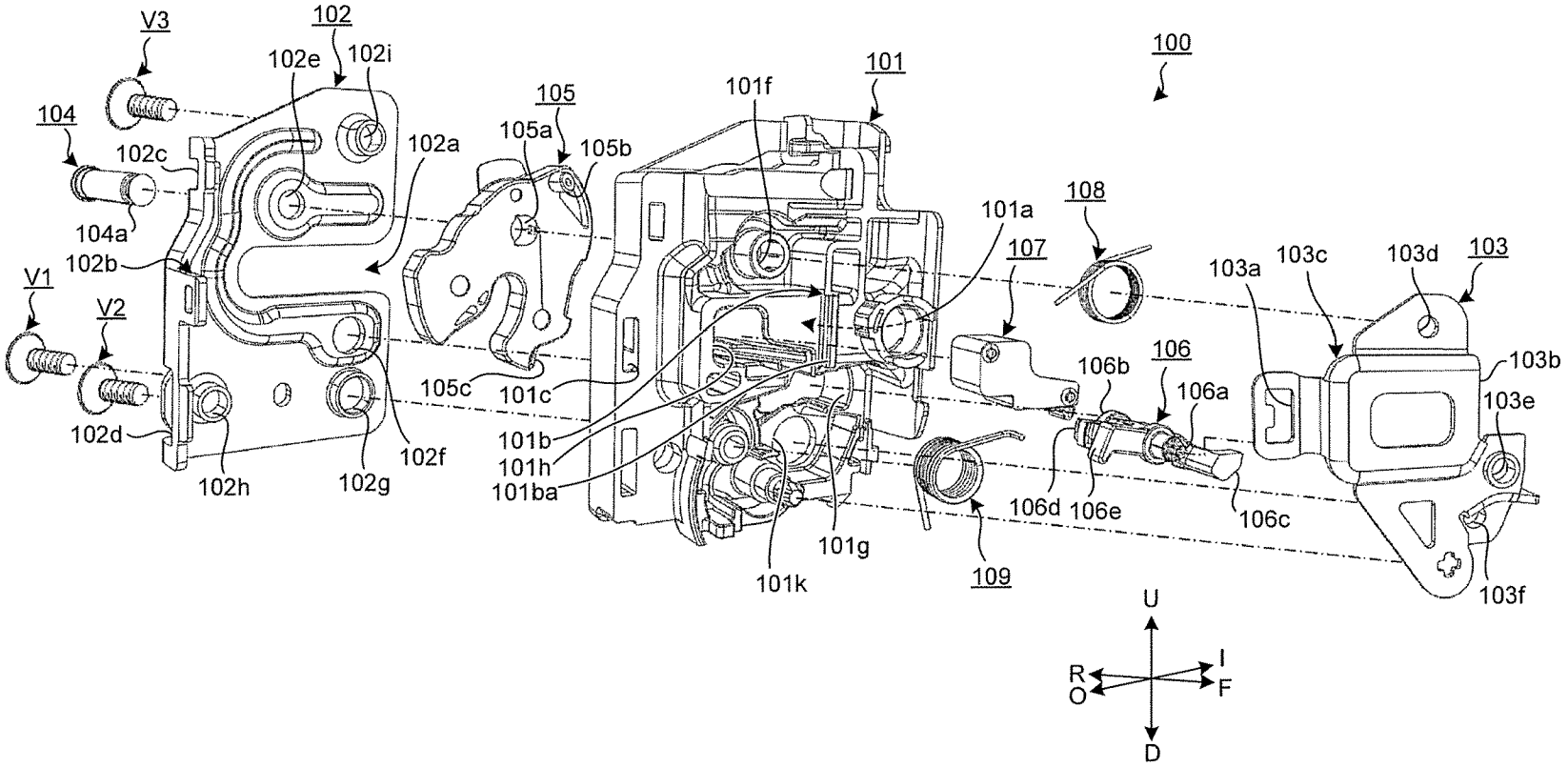
FIG. 2 is an exploded perspective view illustrating a configuration of the vehicle door latch device illustrated in FIG. 1.

Next, a configuration of the door latch device 100 will be described. FIG. 2 is an exploded perspective view illustrating a configuration of the vehicle door latch device illustrated in FIG. 1.

As illustrated in FIG. 2, the door latch device 100 includes a body 101, a cover plate 102 fixed to a rear side of the body 101, a back plate 103 fixed to a front side of the body 101, a latch shaft 104 inserted from the rear side, a latch 105 which is supported to be rotatable by the latch shaft 104 and which can be engaged with a striker, a pole 106 to hold a door in a closed position by being engaged with the latch 105, and a bumper rubber 107 which is included as a buffer abutted to an advanced striker.

The door latch device 100 is connected, via a releasing lever (not illustrated), to an outside handle of the door which handle is in the outside of a vehicle or an inside handle of the door which handle is in the inside of the vehicle. Then, in the door latch device 100, by an opening operation of the outside handle or the inside handle, holding of the latch 105 performed by the pole 106 is released and the engagement between the striker and the latch 105 is released, whereby the door can be opened.

Then, each member of the door latch device 100 will be described in detail.

For example, the body 101 is made of synthetic resin. In one surface (rear side) of the body 101, a striker advancing groove 101*a* into which the striker provided in the vehicle body advances along with a closing movement of the door is formed. Also, the body 101 includes a body rib part 101*b* including an abutted surface 101*ba* orthogonal to an inside-outside direction of the vehicle.

Figure 3:
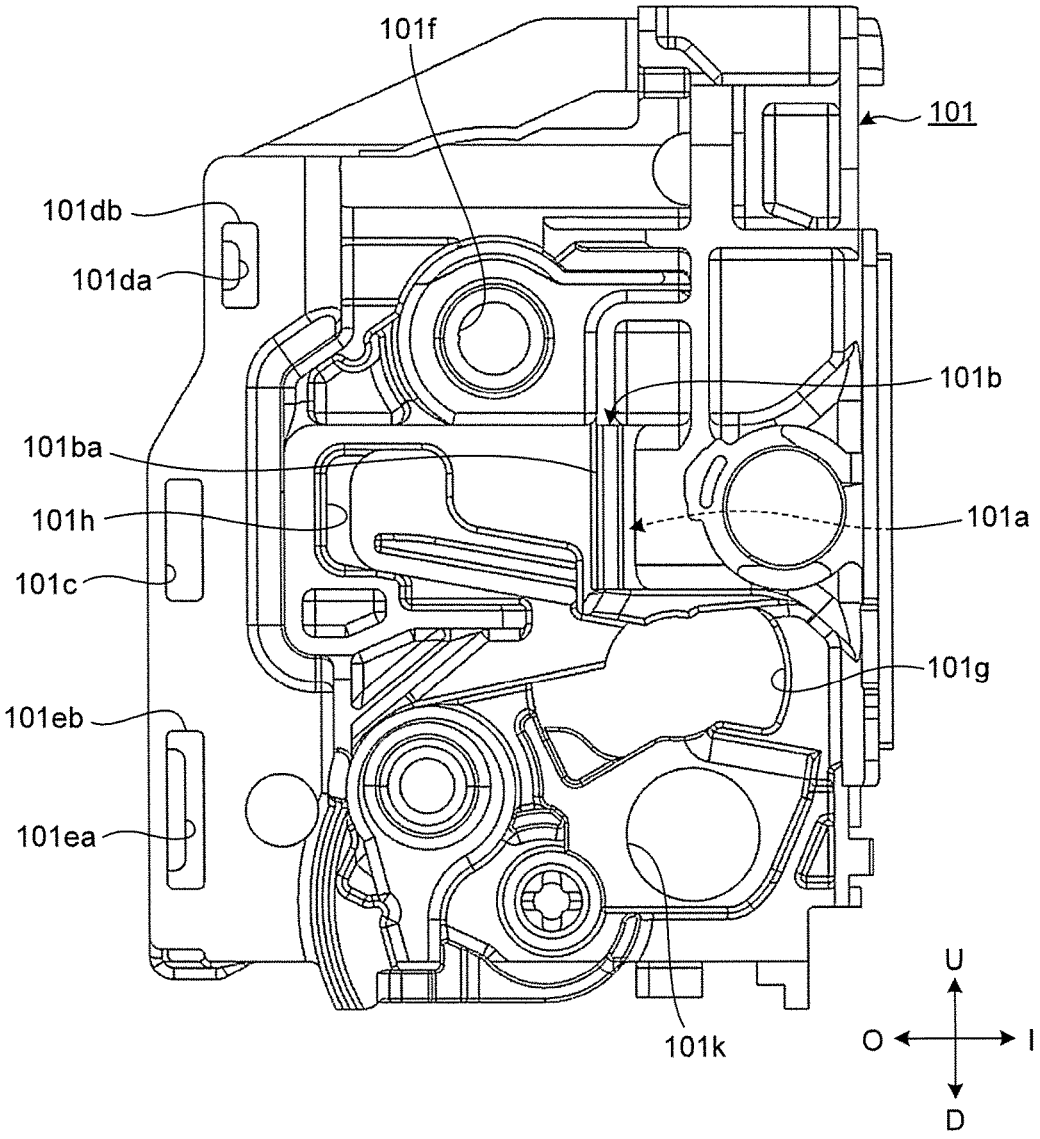
FIG. 3 is a front view of a body illustrated in FIG. 2.
Figure 4:
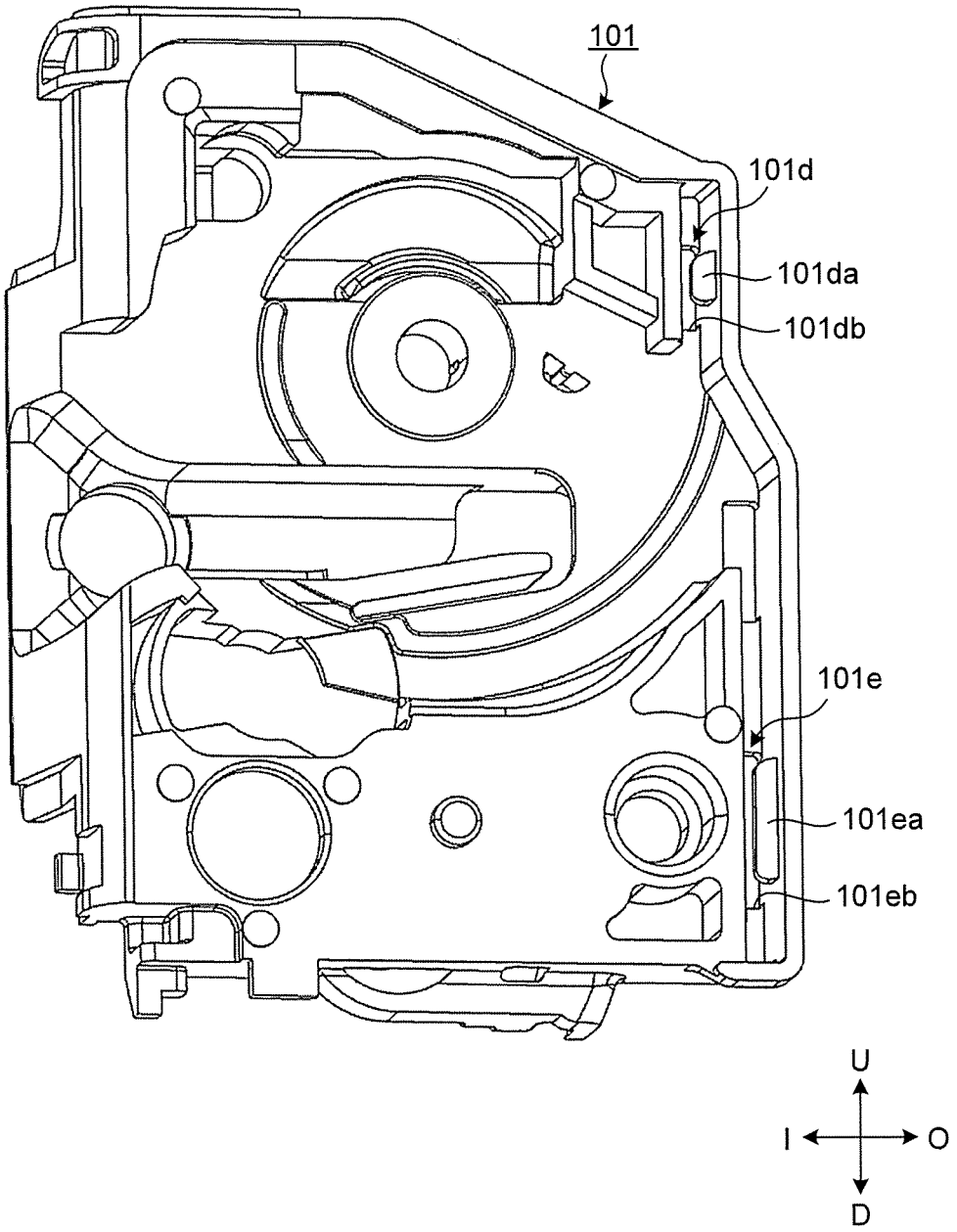
FIG. 4 is a perspective view in which a rear surface side of the body illustrated in FIG. 2 is seen in an inside direction of a vehicle.

FIG. 3 is a front view of the body illustrated in FIG. 2. As illustrated in FIG. 3, the body 101 includes a through-hole 101*c*. FIG. 4 is a perspective view in which a rear surface side of the body illustrated in FIG. 2 is seen in the inside direction of the vehicle. As illustrated in FIG. 4, the body 101 includes a groove part 101*d* and a groove part 101*e* which are elongated in a front-rear direction of the vehicle, on inner wall surfaces of which a claw part 101*da* and a claw part 101*ea* are formed, and in a bottom parts of which a through-hole 101*db* and a through-hole 101*eb* are formed.

Figure 5:
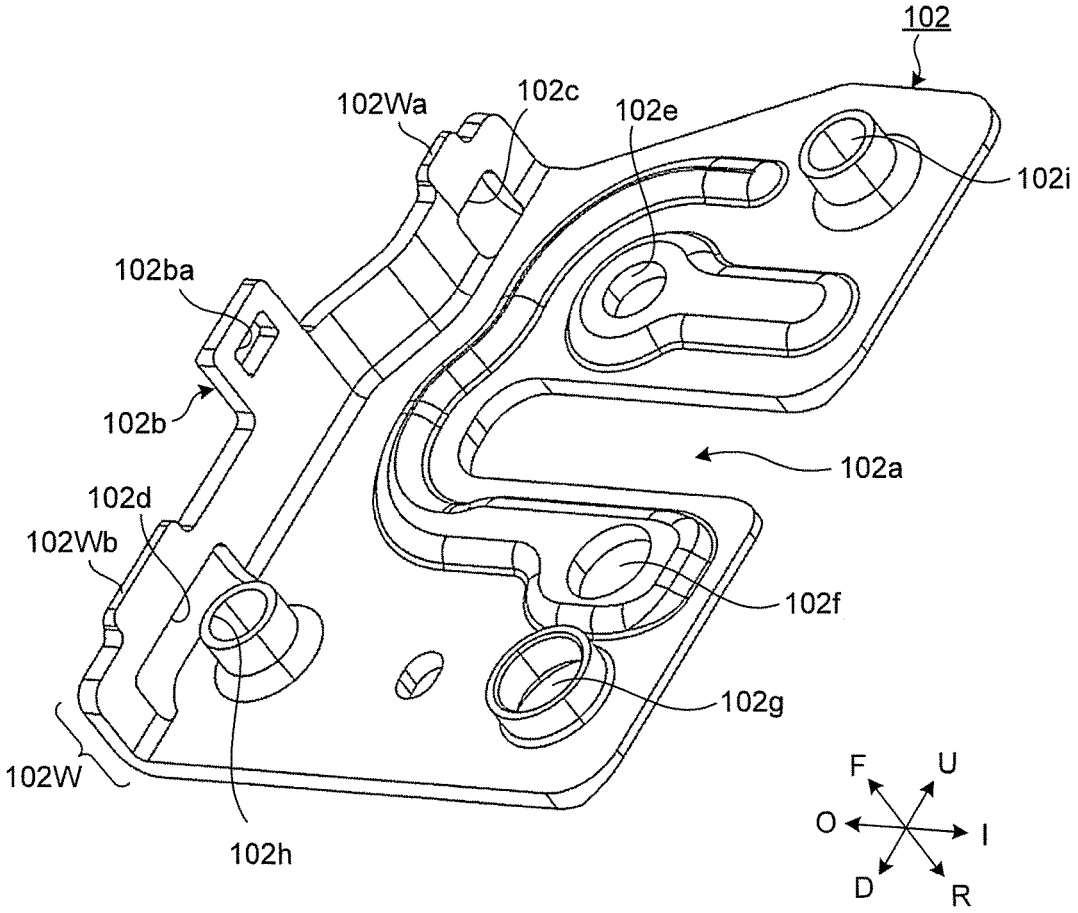
FIG. 5 is an enlarged view of a cover plate illustrated in FIG. 2.

Referring back to FIG. 2, the cover plate 102 is made of, for example, various kinds of metal and includes a notched part 102*a* into which the striker can advance. The cover plate 102 is installed to a surface on a rear side of the body 101 on which the striker advancing groove 101*a* is formed. FIG. 5 is an enlarged view of the cover plate illustrated in FIG. 2. As illustrated in FIG. 5, the cover plate 102 includes a protruding part 102*b* which is elongated to the front side along a surface orthogonal to the inside-outside direction of the vehicle and in a side surface of which an engagement hole 102*ba* is formed. Also, the cover plate 102 includes a wall part 102W elongated to the front side along the surface orthogonal to the inside-outside direction of the vehicle. The wall part 102W includes a fitting hole 102*c* and a fitting hole 102*d*. The fitting hole 102*c* and the fitting hole 102*d* are formed in a wall surface of the wall part 102W and are inserted into the groove part 101*d* and the groove part 101*e* of the body 101, respectively. The claw part 101*da* and the claw part 101*ea* of the body 101 are respectively fitted into the fitting hole 102*c* and the fitting hole 102*d*. Also, the wall part 102W includes a projected part 102Wa and a projected part 102Wb which are respectively fitted into the through-hole 101*db* and the through-hole 101*eb* of the body 101.

Figure 6:
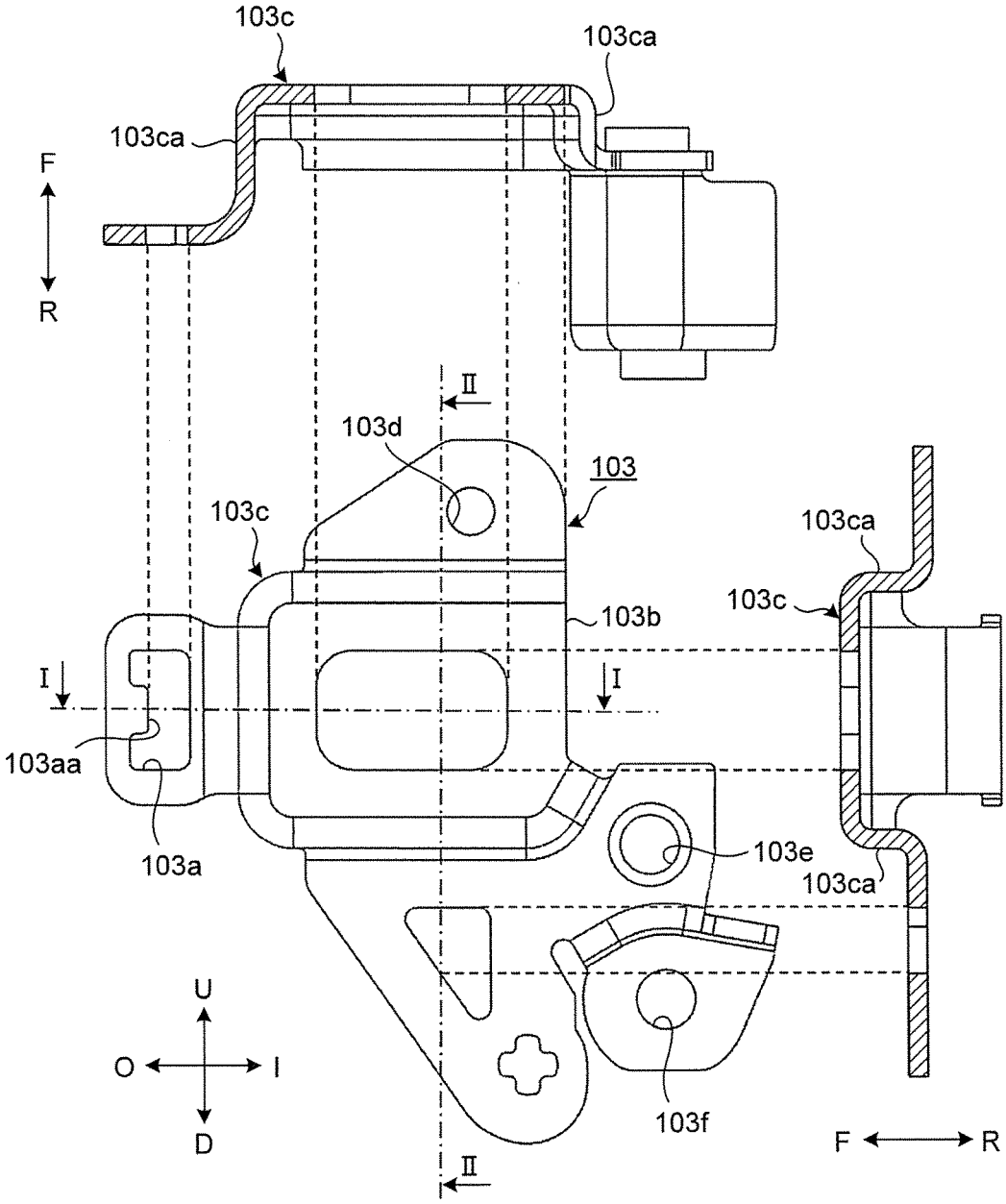
FIG. 6 is a front view and a sectional view of a back plate illustrated in FIG. 2.

Referring back to FIG. 2, the back plate 103 is made of, for example, various kinds of metal and is fixed to the cover plate 102, with the body 101 placed therebetween, by the latch shaft 104 and a bolt V1. As a result, the door latch device 100 is integrated. FIG. 6 is a front view of the back plate illustrated in FIG. 2 and a I-I sectional view (upside in FIG. 6) and a II-II sectional view (right side in FIG. 6) which are illustrated on the front view. As illustrated in FIG. 6, the back plate 103 includes a through-hole 103*a* into which the protruding part 102*b* of the cover plate 102 is inserted and in an inner periphery of which a projected part 103*aa* is formed. Also, the back plate 103 includes a side surface part 103*b* arranged in a vicinity of the abutted surface 101*ba* of the body 101. Moreover, the back plate 103 includes a swelled part 103*c* which is swelled in a direction getting away from the body 101 (to front side) and which includes a side wall surface 103*ca* elongated in the front-rear direction. Then, each part of the back plate 103 which part is formed on a surface extended in a flange shape from the swelled part 103*c* is engaged with each part of the body 101, the cover plate 102, or the like.

Referring back to FIG. 2, the latch shaft 104 supports the latch 105 to be rotatable. The latch shaft 104 pierces a shaft hole 102*e* provided in the cover plate 102. Also, a small-diameter shaft part 104*a* at a leading end is pushed into a shaft hole 103*d*, which is provided in the back plate 103, in a substantially un-rotatable manner via the body 101 in such a manner that a shaft hole 105*a* of the latch 105 and a shaft hole 101*f* of the body 101 are pierced from the rear side in this order.

The latch 105 is pivotally supported by the latch shaft 104 and is housed in an inner part on the rear side of the body 101. The latch 105 holds the door at a closed position by being meshed with the advanced striker and rotated around the latch shaft 104 from an opened position to a latch position. Also, the latch 105 includes an engagement part 105*b* projected to the front side.

Figure 7:
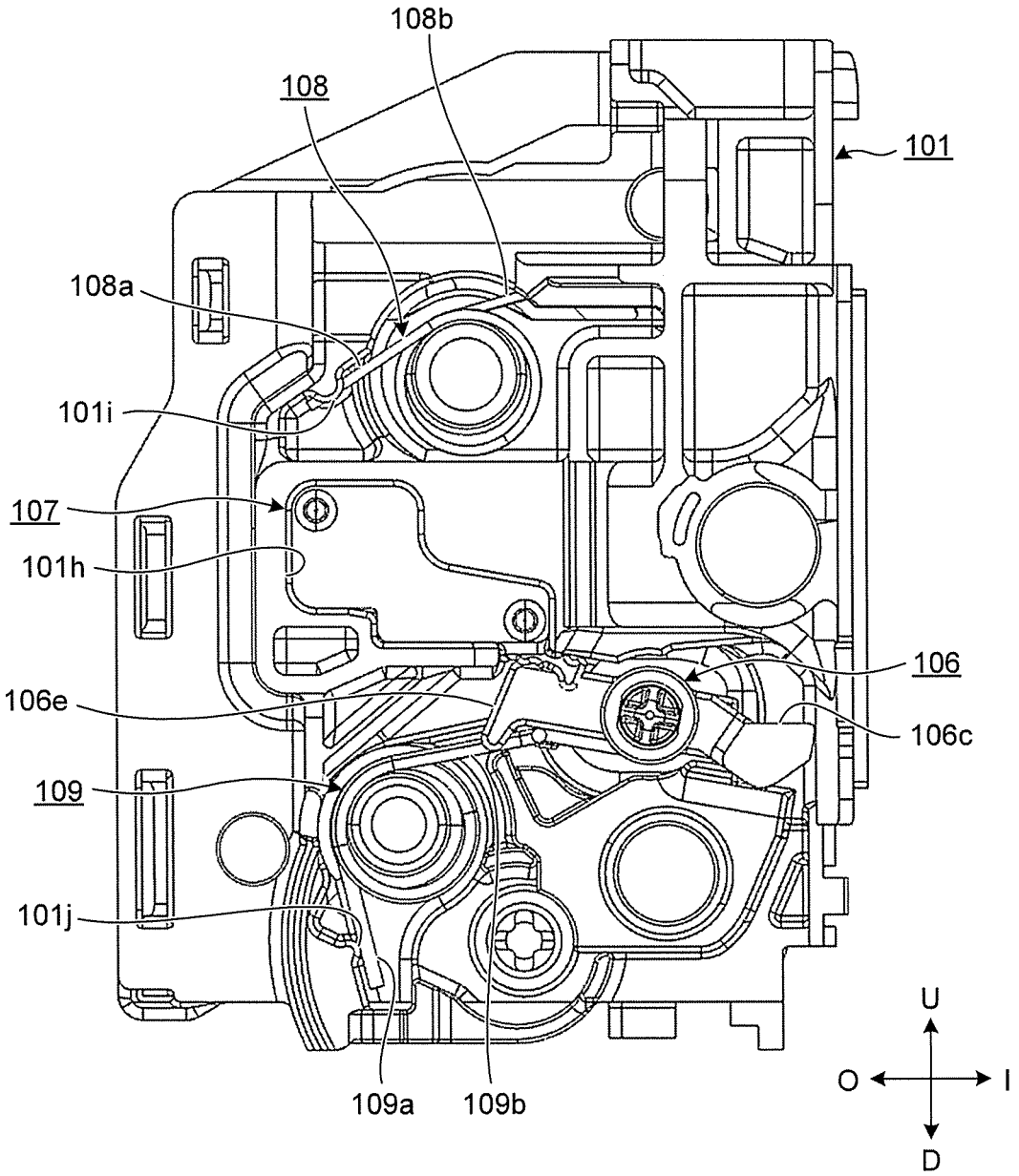
FIG. 7 is a front view illustrating an inner configuration of the vehicle door latch device illustrated in FIG. 2.

FIG. 7 is a front view illustrating an inner configuration of the vehicle door latch device illustrated in FIG. 2. FIG. 7 is a view illustrating the latch 105 at the latch position. By engagement between a spring 108 illustrated in FIG. 7 and the engagement part 105*b* (see FIG. 2), the latch 105 is biased in such a manner as to be rotated from the latch position to the opened position (in counterclockwise direction in FIG. 7).

Referring back to FIG. 2, the pole 106 is installed to a pole installation hole 101*g* formed in the body 101. Moreover, a front shaft part 106*a* is inserted into a shaft hole 103*e* of the back plate 103 and a rear shaft part 106*b* is inserted into a shaft hole 102*f* of the cover plate 102, whereby the pole 106 is supported pivotally in a rotatable manner.

Next, FIG. 7 is a view illustrating the pole 106 at an engagement position. The pole 106 is biased by a spring 109 in such a manner as to be rotated from a release position, at which engagement with the latch 105 is released, in a direction toward the engagement position at which engagement with the latch 105 at the latch position can be performed. That is, the pole 106 is biased in a clockwise direction in FIG. 7.

Then, the pole 106 includes a release lever 106*c* to release engagement with the latch 105 by rotating the pole 106 via a releasing lever (not illustrated) from the engagement position to the release position based on the opening operation of the handle provided on the door.

Figure 8:
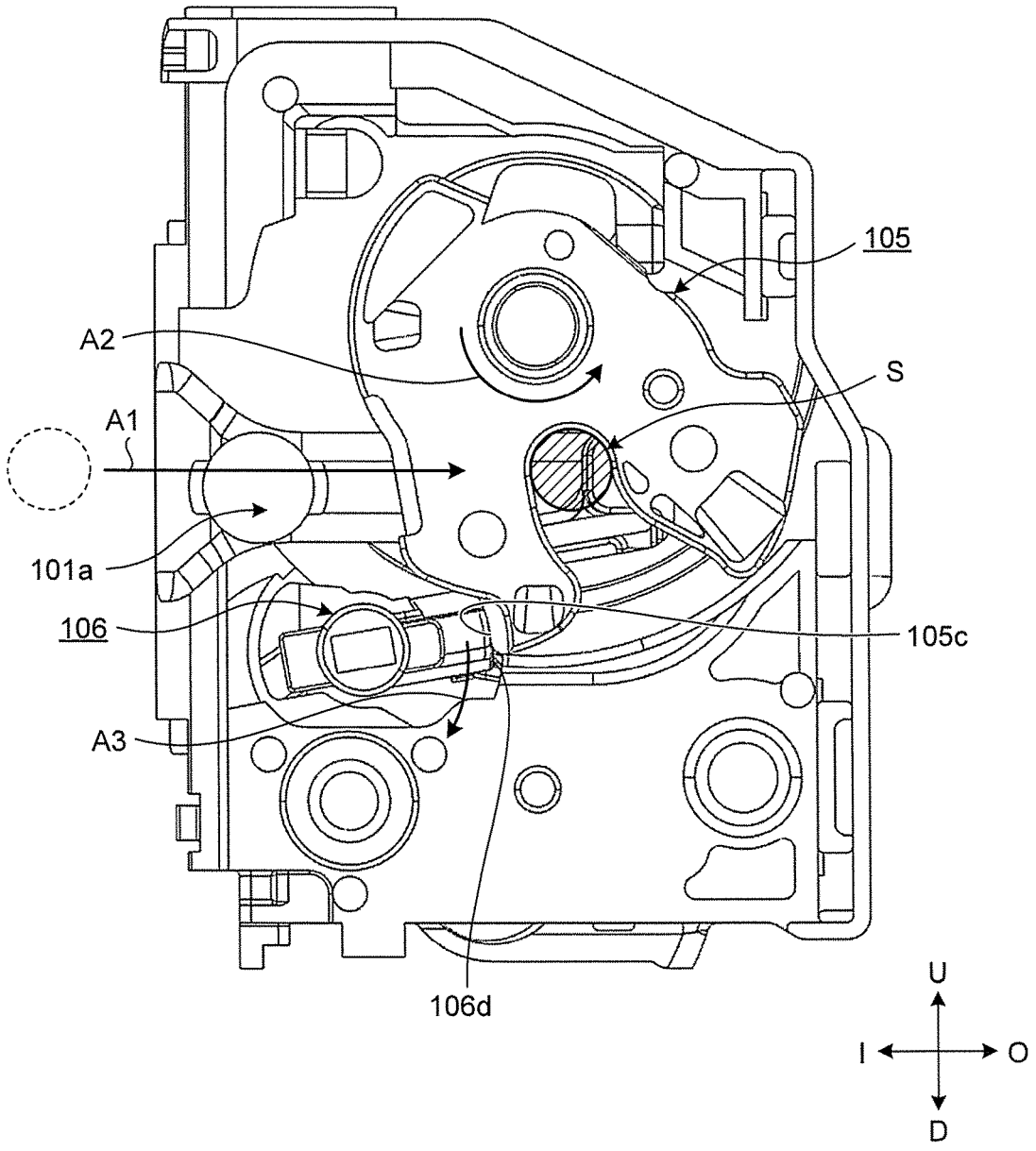
FIG. 8 is a rear view illustrating the inner configuration of the vehicle door latch device illustrated in FIG. 2.

FIG. 8 is a rear view illustrating an inner configuration of the vehicle door latch device illustrated in FIG. 2. FIG. 8 is a view illustrating the pole 106 at the engagement position. The pole 106 is biased in the counterclockwise direction. As a result, the pole 106 is rotated from the engagement position to the release position along with rotation of the latch 105. Then, the pole 106 is rotated from the release position to the engagement position by biasing force and is engaged with the latch 105, whereby the door is held at the closed position. Also, the pole 106 includes an engagement part 106*d* which can be engaged with the latch 105 meshed with a striker S.

Referring back to FIG. 7, the bumper rubber 107 includes an elastic member such as rubber and absorbs impact when the striker S advances. Also, the bumper rubber 107 is fitted into a bumper rubber installation hole 101*h* formed in the body 101 and at least a part of the back plate 103 is stacked from the front side, whereby the bumper rubber 107 is housed between the body 101 and the back plate 103. As a result, the bumper rubber 107 is prevented from being dropped from the door latch device 100.

One end 108*a* of the spring 108 is locked to a projected part 101*i* on the front side, which is a front side on a plane of paper, of the body 101 and the other end 108*b* thereof is locked to the engagement part 105*b* (see FIG. 2) of the latch 105, whereby the latch 105 is biased.

One end 109*a* of the spring 109 is locked to a projected part 101*j* of the body 101 and the other end 109*b* thereof is locked to the engagement part 106*e* of the pole 106, whereby the pole 106 is biased.

Referring back to FIG. 2, the bolt V1 pierces an installation hole (not illustrated) in an inner panel of the door, a through-hole 102*g* of the cover plate 102, and a through-hole 101*k* of the body 101 in this order and is screwed into a screw hole 103*f* of the back plate 103.

A bolt V2 and a bolt V3 pierce installation holes (not illustrated) in the inner panel of the door and are respectively screwed into a screw hole 102*h* and a screw hole 102*i* in the cover plate 102. The door latch device 100 is fixed to the inner panel of the door by these bolt V1 to bolt V3. Here, the bolt V1 is also screwed into the screw hole 103*f* of the back plate 103, whereby the back plate 103 is fixed to a rear surface of the body 101.

Next, an operation of the door latch device 100 will be described.

First, an operation of the door latch device 100 of when the door is brought into a closed state from an opened state will be described. When the closing operation of the door is performed and the striker S advances into the striker advancing groove 101*a* of the body 101 as indicated by an arrow A1 in FIG. 8, the latch 105 is rotated, as indicated by an arrow A2, from the opened position to the latch position illustrated in FIG. 8. Here, in an innermost part of the striker advancing groove 101*a* of the body 101, the striker S and the bumper rubber 107 are abutted to each other.

Moreover, the engagement part 106*d* of the pole 106 is abutted to the latch 105 and is pushed down, whereby the pole 106 is rotated in a direction indicated by an arrow A3. Then, the pole 106 is rotated in a direction biased by the spring 109 (counterclockwise direction in FIG. 8) and an engagement part 105*c* of the latch 105 and the engagement part 106*d* of the pole 106 are engaged with each other. A state in which the striker S and the latch 105 are meshed with each other and the engagement part 105*c* of the latch 105 and the engagement part 106*d* of the pole 106 are engaged with each other is the closed state of the door.

Next, an operation of the door latch device 100 of when the door is brought into the opened state from the closed state will be described. In the closed state of the door, when an input based on an opening operation of a handle is performed with respect to the release lever 106*c* of the pole 106, the pole 106 is rotated from the engagement position to the release position as indicated by the arrow A3 in FIG. 8 and engagement between the engagement part 105*c* of the latch 105 and the engagement part 106*d* of the pole 106 is released. Then, the latch 105 is rotated from the latch position to the opened position by biasing force and mesh between the striker S and the latch 105 is released. When the door is further operated to be opened in the outside direction of the vehicle from this state, the door is brought into the opened state. Note that when an input based on the opening operation of the handle is released, the pole 106 is rotated from the release position back to the engagement position by the biasing force of the spring 109.

Here, a state of each part of the door latch device 100 of when a vehicle to which the door latch device 100 is attached collides and force is applied to the door latch device 100 from the outside of the vehicle will be described.

First, with the body 101 and the cover plate 102 and the back plate 103 which are fixed to each other via the body 101, the door latch device 100 houses a member such as the latch 105 or the pole 106 to hold the door at the closed position. Thus, it is important that unnecessary deformation of three members which are the body 101, the cover plate 102, and the back plate 103 is not caused in collision of the vehicle and that each part housed in an inner part is protected.

Figure 9:
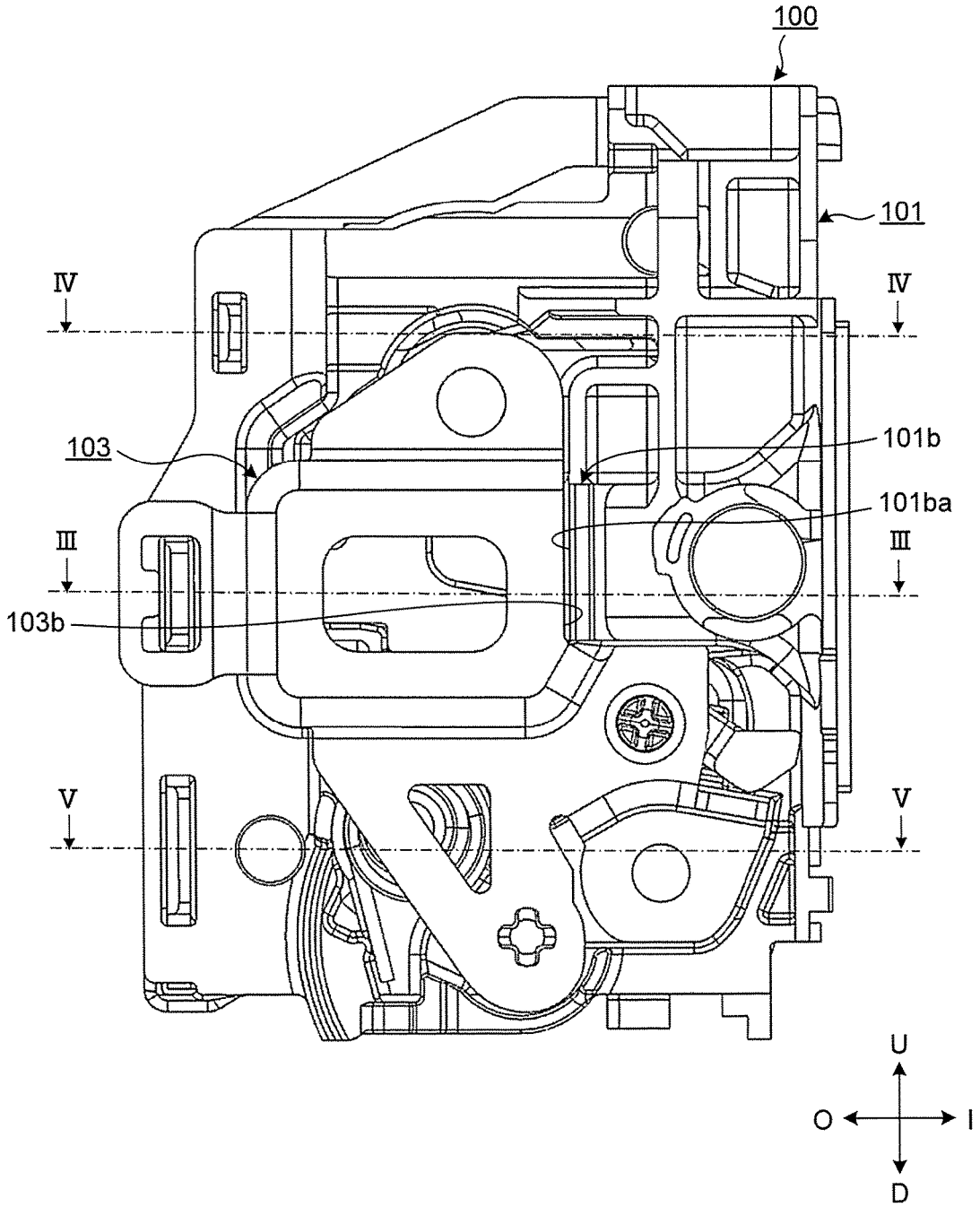
FIG. 9 is a front view of the vehicle door latch device illustrated in FIG. 2.
Figure 10:
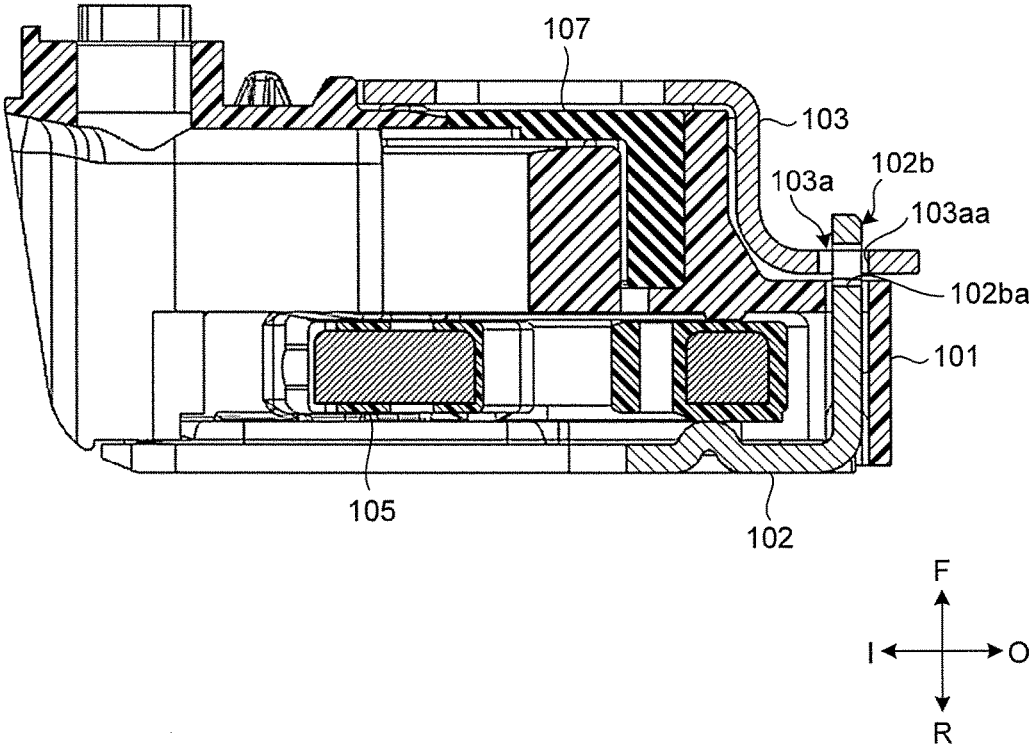
FIG. 10 is a III-III sectional view of the vehicle door latch device illustrated in FIG. 9.

FIG. 9 is a front view of the vehicle door latch device illustrated in FIG. 2. FIG. 10 is a III-III sectional view of the vehicle door latch device illustrated in FIG. 9. As illustrated in FIG. 10, the through-hole 103*a* of the back plate 103 includes the projected part 103*aa* which is arranged in the outside of the vehicle and which is projected in an inside-outside direction of the vehicle when the door latch device 100 is attached to a vehicle. Also, the protruding part 102*b* of the cover plate 102 includes the engagement hole 102*ba* into which the projected part 103*aa* of the back plate 103 advances when the projected part 103*aa* is displaced in the inside direction of the vehicle by deformation due to force applied from the outside of the vehicle. As a result, by collision of the vehicle, the projected part 103*aa* of the back plate 103 advances and fits into the engagement hole 102*ba* of the cover plate 102, whereby the back plate 103 and the cover plate 102 fit into each other. Accordingly, a breakdown of the door latch device 100 caused by a release of the engagement between the back plate 103 and the cover plate 102 is prevented. Thus, the door latch device 100 is a vehicle door latch device with high impact resistance.

Note that as illustrated in FIG. 10, in a state before collision of the vehicle, the projected part 103*aa* of the back plate 103 is not inserted into the engagement hole 102*ba* of the cover plate 102. Thus, in a case of installing the back plate 103, it is possible to install the back plate 103 to the cover plate 102 via the body 101 in such a manner that the back plate 103 is stacked straight from the front side of the vehicle. In the door latch device 100, since the cover plate 102 includes the engagement hole 102*ba* and the back plate 103 includes the projected part 103*aa*, impact resistance is high and deterioration in assembly efficiency is suppressed.

Also, as illustrated in FIG. 9, the body 101 includes the body rib part 101*b* including the abutted surface 101*ba* and the back plate 103 includes the side surface part 103*b* arranged in a vicinity of the abutted surface 101*ba* of the body 101. As a result, when the back plate 103 is deformed due to force applied from the outside of the vehicle by collision of the vehicle, the abutted surface 101*ba* of the body 101 and the side surface part 103*b* of the back plate 103 are abutted to each other. Here, the force applied to the back plate 103 by the collision is dispersed and absorbed on the abutted surface 101*ba*. Thus, unintended deformation of the body 101 and the back plate 103 is prevented. Thus, the door latch device 100 is a vehicle door latch device with high impact resistance.

Note that designing is performed in such a manner that a small gap is generated between the abutted surface 101*ba* of the body 101 and the side surface part 103*b* of the back plate 103 in a state before the collision of the vehicle. As a result, in a case of installing the back plate 103 to the body 101, deterioration in assembly efficiency due to contact between the abutted surface 101*ba* of the body 101 and the side surface part 103*b* of the back plate 103 is suppressed.

Also, as illustrated in FIG. 6, the back plate 103 includes the swelled part 103*c* including the side wall surface 103*ca*.

As a result, rigidity of the back plate 103 is improved compared to a case where no side wall surface 103*ca* is formed. Thus, the door latch device 100 is a vehicle door latch device with high impact resistance.

Note that as illustrated in FIG. 6, the back plate 103 includes the side wall surface 103*ca* on each of side surfaces in three directions excluding the side surface part 103*b* among side surfaces of the swelled part 103*c* which surfaces are elongated in the front-rear direction of the vehicle. However, in order to improve rigidity, it is only necessary to form a side wall surface on at least a part of the side surfaces of the swelled part 103*c* which surfaces are elongated in the front-rear direction of the vehicle. Specifically, in order to improve rigidity with respect to a force from the outside of the vehicle toward the inside of the vehicle, it is only necessary to form a side wall surface on a side surface elongated in the inside-outside direction of the vehicle among the side surfaces of the swelled part 103*c* which surfaces are elongated in the front-rear direction of the vehicle.

Figure 11:
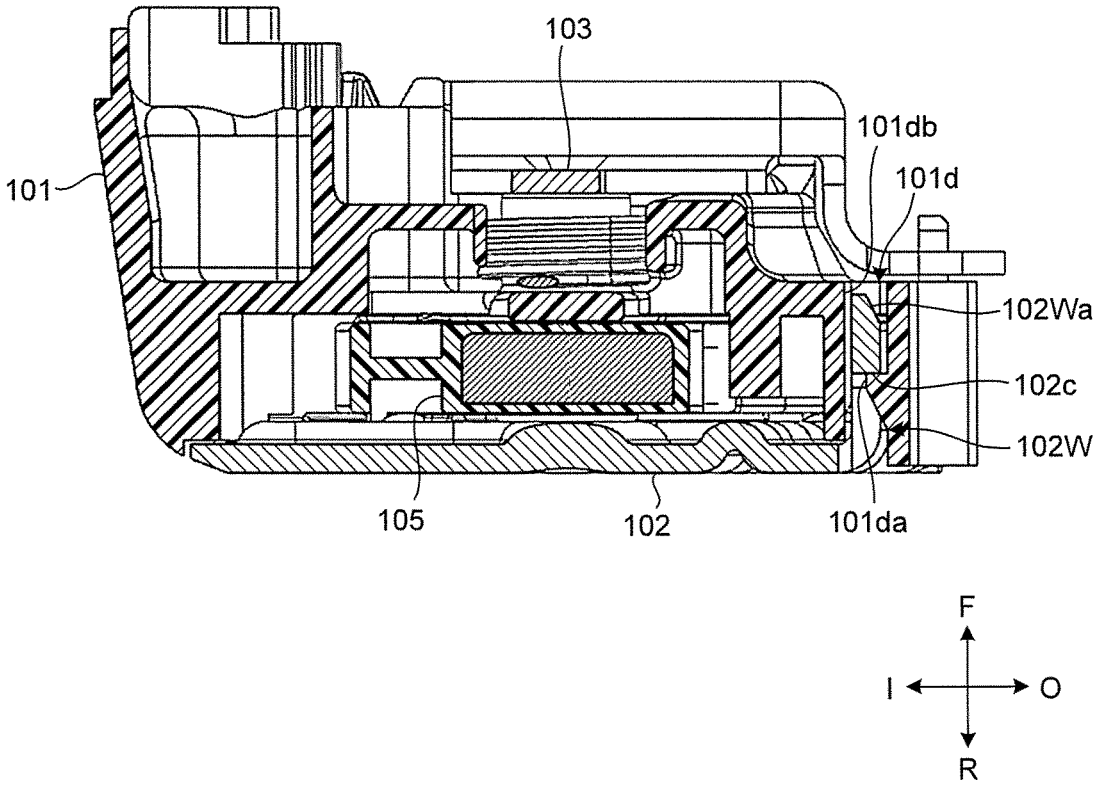
FIG. 11 is a IV-IV sectional view of the vehicle door latch device illustrated in FIG. 9.

FIG. 11 is a IV-IV sectional view of the vehicle door latch device illustrated in FIG. 9. As illustrated in FIG. 11, the claw part 101*da* formed in the groove part 101*d* of the body 101 is fitted into the fitting hole 102*c* formed in the wall part 102W of the cover plate 102, whereby the body 101 and the cover plate 102 are locked in such a manner that positions thereof are not deviated in the front-rear direction. Moreover, the projected part 102Wa formed on the wall part 102W of the cover plate 102 is fitted into the through-hole 101*db* formed in the groove part 101*d* of the body 101, whereby the body 101 and the cover plate 102 are locked in such a manner that positions thereof are not deviated in the inside-outside direction of the vehicle and in the up-and-down direction.

Figure 12:
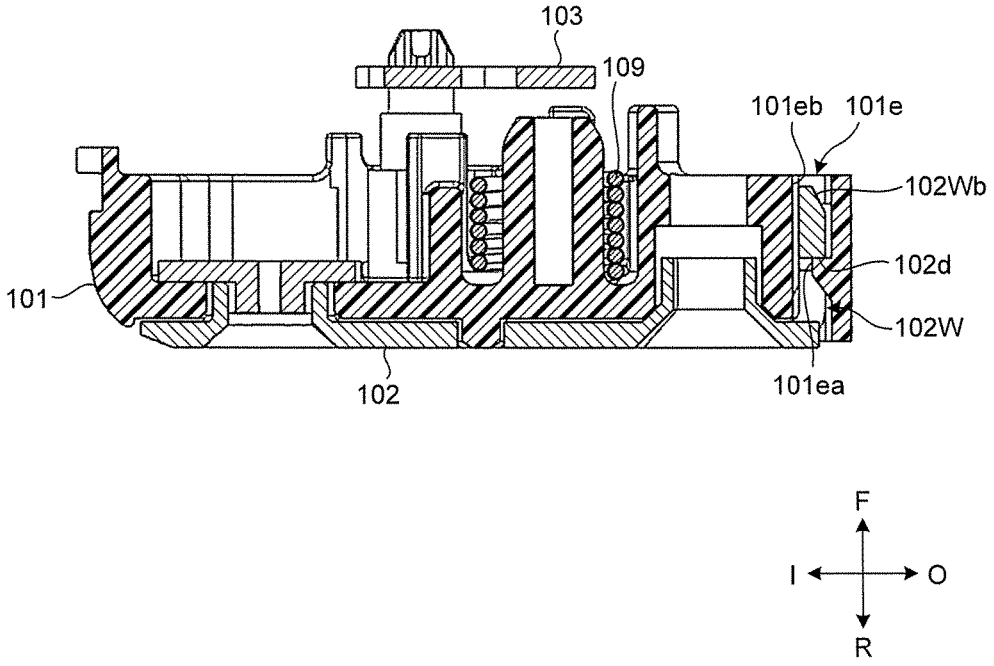
FIG. 12 is a V-V sectional view of the vehicle door latch device illustrated in FIG. 9.

FIG. 12 is a V-V sectional view of the vehicle door latch device illustrated in FIG. 9. As illustrated in FIG. 12, the claw part 101*ea* formed in the groove part 101*e* of the body 101 is fitted into the fitting hole 102*d* formed in the wall part 102W of the cover plate 102, whereby the body 101 and the cover plate 102 are locked in such a manner that positions thereof are not deviated in the front-rear direction. Moreover, the projected part 102Wb formed on the wall part 102W of the cover plate 102 is fitted into the through-hole 101*eb* formed in the groove part 101*e* of the body 101, whereby the body 101 and the cover plate 102 are locked in such a manner that positions thereof are not deviated in the inside-outside direction of the vehicle and in the up-and-down direction.

As described above, in the door latch device 100, the body 101 and the cover plate 102 are tightly locked to each other in each direction, whereby unintended deformation due to external force is suppressed. Thus, the door latch device 100 is a vehicle door latch device with high impact resistance.

Note that the body 101 is stacked on the cover plate 102 which is set in an automatic assembly line or the like in such a manner that the front side faces upward, whereby the body 101 and the cover plate 102 are installed. Here, when the wall part 102W of the cover plate 102 advances into the groove part 101*d* and the groove part 101*e* of the body 101, first, the claw part 101*da* and the claw part 101*ea* of the body 101 are abutted to the projected part 102Wa and the projected part 102Wb of the wall part 102W. As illustrated in FIG. 12, an inclination surface is formed in each of rear sides of the claw part 101*da* and the claw part 101*ea* of the body 101 and front sides of the projected part 102Wa and the projected part 102Wb of the wall part 102W. Thus, each of the body 101 and the cover plate 102 is gradually bended by elasticity of a member and the claw part 101*da* and the claw part 101*ea* of the body 101 are smoothly fitted into the fitting hole 102*c* and the fitting hole 102*d* of the cover plate 102. In such a manner, each of the claw part 101*da* and the claw part 101*ea* of the body 101 and the projected part 102Wa and the projected part 102Wb of the wall part 102W includes an inclination surface. Thus, deterioration in assembly efficiency is suppressed.

As described above, the door latch device 100 according to the present invention is a vehicle door latch device with high impact resistance.

Note that in the above embodiment, it has been described that the vehicle door latch device is provided on the door side and the striker is provided on the vehicle body side. However, the present invention is not limited to this. That is, the present invention can be also applied to a case where the vehicle door latch device is provided on the vehicle body side and the striker is provided on the door side.

Also, in the above embodiment, it has been described that the vehicle door latch device is attached to a rear side door of an automobile. However, a vehicle door latch device of the present invention can be also attached to a front side door.

Also, in the above embodiment, it has been described that the vehicle door latch device is attached to a right door of an automobile. However, in a case of attaching a vehicle door latch device of the present invention to a left door of an automobile, a configuration which is symmetric with respect to a plane surface in a front-rear direction of the vehicle is to be included.

Also, in the above embodiment, it has been described that the back plate includes the projected part and the cover plate includes the engagement hole in the door latch device. However, a configuration in which the back plate includes an engagement hole and the cover plate includes a projected part may be included.

According to the embodiment, a vehicle door latch device includes a body, a cover plate installed to one surface of the body, and a back plate fixed to the cover plate with the body placed therebetween. Then, when the vehicle door latch device is attached to a vehicle, one of the cover plate or the back plate is arranged in the outside of the vehicle and includes a projected part which is projected in an inside-outside direction of the vehicle. Also, the other one of the cover plate or the back plate includes an engagement hole into which the projected part advances when the projected part is displaced in the inside direction of the vehicle by deformation due to force applied from the outside of the vehicle. As a result, the projected part advances and fits into the engagement hole by vehicle collision and the back plate and the cover plate fit into each other. Accordingly, engagement between the back plate and the cover plate is prevented from being released in the vehicle collision or the like and the door latch device is prevented from being broken, and thus, a vehicle door latch device with high impact resistance can be realized.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A vehicle door latch device comprising:

a body which is provided in one of a door of a vehicle or a vehicle body, and includes a striker advancing groove, being formed on one surface of the body and into which a striker, provided in the other one of the door or the vehicle body, advances along with closing movement of the door;

a latch configured to be meshed with the striker to hold the door at a closed position after the striker has advanced into the striker advancing groove;

a cover plate installed on the surface of the body on which the striker advancing groove is formed; and a back plate fixed to the cover plate with the body placed therebetween, wherein the back plate includes a projected part which is arranged on an outer side of the vehicle when the vehicle door latch device is attached to the vehicle and which is projected in an inside-outside direction of the vehicle, and the cover plate includes an engagement hole into which the projected part advances when the projected part is displaced in an inside direction of the vehicle by deformation due to a force applied to the vehicle door latch device from outside of the vehicle, the cover plate includes a protruding part which is elongated along a surface orthogonal to the inside-outside direction of the vehicle and is formed in a side surface of the engagement hole, and the back plate includes a through-hole into which the protruding part of the cover plate is inserted and in an inner periphery of which, the projected part is formed.

2. The vehicle door latch device according to claim 1, wherein the body includes a body rib part including an abutted surface orthogonal to the inside-outside direction of the vehicle, and the back plate includes a side surface part which is abutted to the abutted surface by the deformation.

3. The vehicle door latch device according to claim 1, wherein the back plate includes a swelled part which is swelled in a direction away from the body and which includes a side wall surface elongated in a front-rear direction of the vehicle.

4. The vehicle door latch device according to claim 1, further comprising:

a latch shaft configured to support the latch so as to rotatable; and a buffer, which includes an elastic member, and which absorbs impact when the striker advances into the striker advancing groove, wherein the latch shaft is configured to pierce a shaft hole provided in the cover plate and to be pushed into a shaft hole provided in the back plate via the body in an un-rotatable manner, and the buffer is fitted into the body and is housed between the body and the back plate by being sandwiched between the body and at least a part of the back plate.

5. The vehicle door latch device according to claim 1, wherein the body includes a groove part which is elongated in a front-rear direction and on an inner wall surface of which, a claw part is formed, and the cover plate includes a wall part which is inserted into the groove part of the body, and a wall surface of the wall part includes a fitting hole formed therein into which the claw part of the body is fitted.

* * * * *